United States Patent [19]

Schwemin

[11] 4,209,061

[45] Jun. 24, 1980

[54] HEAT EXCHANGER

[75] Inventor: Arnold J. Schwemin, Danville, Calif.

[73] Assignee: Energy Dynamics, Inc., Oakland, Calif.

[21] Appl. No.: 802,637

[22] Filed: Jun. 2, 1977

[51] Int. Cl.[2] ..... F28D 17/00

[52] U.S. Cl. ..... 165/10; 60/526; 62/6

[58] Field of Search ..... 165/4, 10, 154, 164, 165/179; 60/517, 524, 526; 62/6

[56] References Cited

U.S. PATENT DOCUMENTS

| | | | |
|---|---|---|---|
| 3,148,512 | 9/1964 | Hoffman et al. | 62/6 |
| 3,216,484 | 11/1965 | Gifford | 165/4 |
| 3,534,813 | 10/1970 | Fleming | 62/6 X |

FOREIGN PATENT DOCUMENTS

| | | | |
|---|---|---|---|
| 479945 | 11/1975 | U.S.S.R. | 62/6 |

*Primary Examiner*—Albert W. Davis
*Attorney, Agent, or Firm*—Harris Zimmerman

[57] ABSTRACT

A heat exchanger for use in a Stirling cycle engine includes a plurality of disc-like plates which are stacked in coaxial fashion within a cylindrical housing, and are supported thereby. The plates are all identical, and are provided with a matrix of perforations extending therethrough parallel to the axis of the heat exchanger. The plates are all parallel and spaced slightly apart, and each plate is rotated about the axis of the device approximately two percent from the adjacent plates. The cylindrical housing includes a plurality of radially extending fins which are disposed within an annular fluid jacket.

5 Claims, 9 Drawing Figures

HEAT EXCHANGER

BACKGROUND OF THE INVENTION

The following United States patents are the closest prior art known to the inventor: Nos.

1,508,860
2,016,164
2,028,298
2,451,629
2,879,976
3,228,460
3,409,075

These prior art patents generally disclose heat exchanger devices which employ perforated plates or members as heat exchanging elements. All of these devices may be characterized by the fact that the heat exchanging elements are perforated in random fashion, and are oriented randomly in the heat exchanging assembly.

In these prior art devices, the perforated heat exchanging members are assembled to facilitate the flow of a pressurized fluid in an axial direction therethrough. The fluid flow through the randomly oriented members causes the fluid to be exposed to a rather large surface area, and this high surface exposure provides ample opportunity for the fluid to exchange thermal energy with the perforated members. The result is a fairly efficient heat exchanger which is quite suitable for many purposes.

In the specific application of the heat exhanger of a Stirling cycle engine, it is necessary to have the highest possible heat transfer rate with a very low volume of gas in the heat exchanger and a minimum of impedance to the flow of gas. Due to the randomness of the orientation of the perforated heat exchanging members in the prior art devices, this is not possible. If the perforations of the multiple heat exchanging members are substantially aligned, the flow of fluid is maximized and there is very little impedance of this flow.

On the other hand, if the perforations of the heat transfer members are substantially mis-aligned, the axial flow is completely interrupted and the flow impedance is thus quite high. In this case, the flow impedance would be a substantial factor affecting the performance of the Stirling cycle engine.

SUMMARY OF THE PRESENT INVENTION

The present invention generally comprises a highly efficient heat exchanger which is adapted to provide the highest heat transfer rates at very low fluid volume. It comprises a cylindrical housing which supports a plurality of disc-like plates disposed in spaced, axially stacked relationship. The cylindrical housing includes a plurality of radially outwardly extending fins which are disposed within a fluid tight jacket which is provided for the circulation of liquid metal, vapor, or similar heat exchanging fluid.

All of the heat exchanging plates are identical in their provision of a plurality of perforations extending parallel to the axis of the device, the perforations disposed in a regular matrix in each plate. The plates are purposely mis-aligned in that each plate is rotated about the axis of the device approximately two percent with respect to the adjacent plates. Thus the corresponding perforations in the plates are disposed in helical fashion within the housing of the device. Thus a portion of the flow passing through each perforation is sheared off by the misalignment with the succeeding perforation, causing a small portion of the flow to be diverted radially and laminarly between the adjacent plates. This laminar flow produces the high heat transfer rate which is required for a Stirling cycle engine. At the same time, the slight misalignment of the perforations does not add substantially to the flow impedance of the device.

The helical pattern of the alignment of the perforations causes the fluid to flow in a generally helical path, except for that which is diverted into laminar flow between the plates. The helical flow imparts an angular momentum to the fluid and causes it to flow outwardly as it traverses axially, thus increasing the radius of the helical path. This angular momentum effect causes the fluid to flow throughout the entire device, thereby maximizing the surface area at which heat transfer is taking place.

The axial spacing between the perforated plates is carefully selected to optimize the laminar flow and the heat transfer therefrom without increasing the fluid friction of the entire device. The optimum axial spacing of the plates provides a volumn between adjacent plates which is equal to the volumn of fluid which is sheared off by the misalignment of the perforations of successive plates.

A BRIEF DESCRIPTION OF THE DRAWINGS

DESCRIPTION OF THE PREFERRED EMBODIMENT

The present invention generally comprises a highly efficient heat exchanger which is particularly adapted for use in a Stirling cycle engine. A thorough discussion of Stirling cycle engines is given in the book STIRLING CYCLE MACHINES, by Graham Walker, published by Oxford University Press in 1973. A particular embodiment of the Stirling cycle engine is disclosed in U.S. Pat. No. 3,478,511, issued Nov. 18, 1969, to Arnold J. Schwemin.

Figure 1:
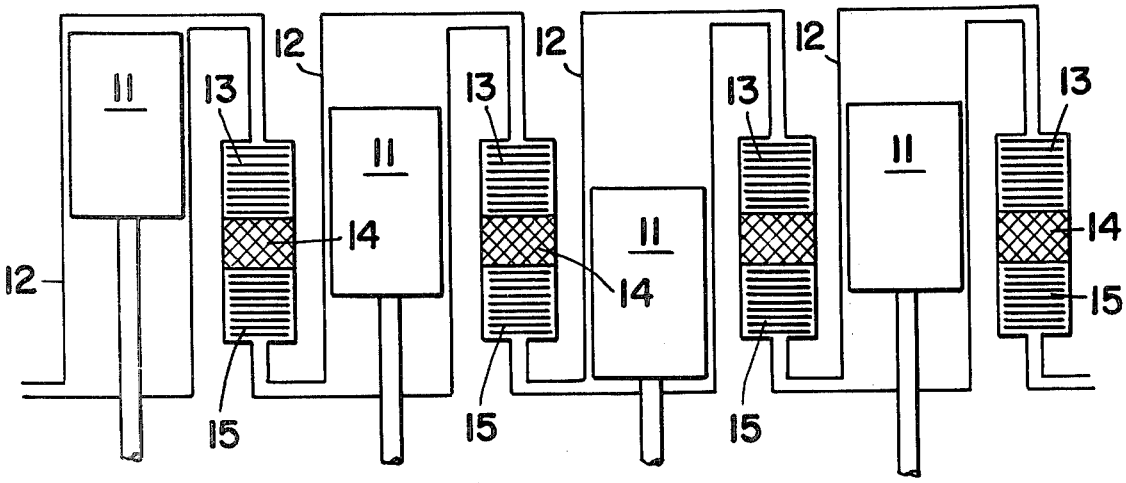
FIG 1 (PRIOR ART)
FIG. 1 is a schematic view of a Stirling cycle engine known in the prior art.

As shown in FIG. 1, a typical prior art Stirling engine includes a plurality of pistons 11 disposed within an equal number of cylinders 12. The pistons 11 are disposed within the cylinders 12 in a pressure-tight manner which allows translation of the piston. The lower end of each cylinder is connected to the upper end of one of the adjacent cylinders so that the downstroke of one piston provides working fluid to the upper end of the adjacent cylinder. The means of interconnection include a heater 13, a thermal regenerator 14, and a cooler 15. Both the heater 13 and the cooler 15 comprise highly efficient heat exchangers.

Figure 2:
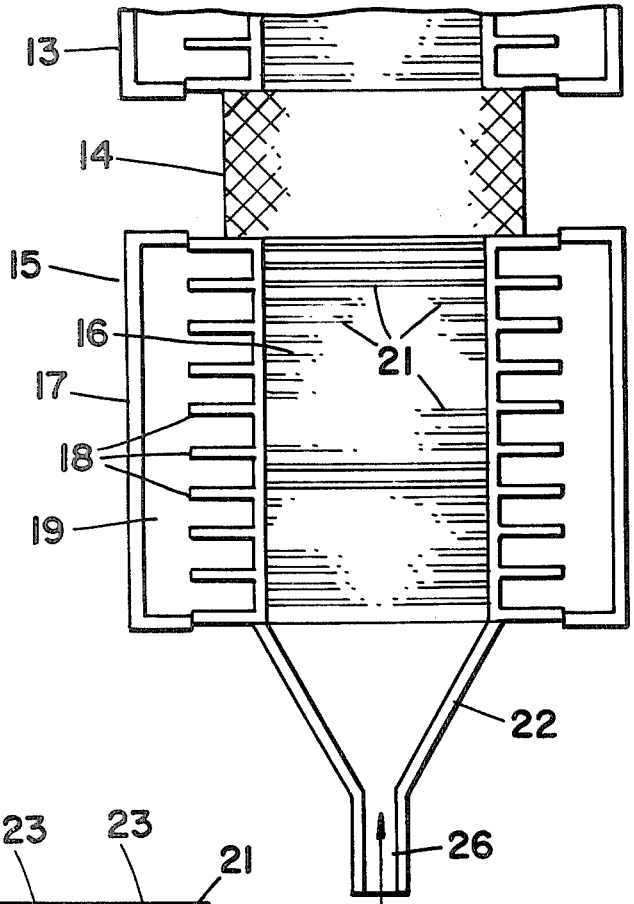
FIG. 2 is a cross-sectional view of the heat exchanger of the present invention.
Figure 5:
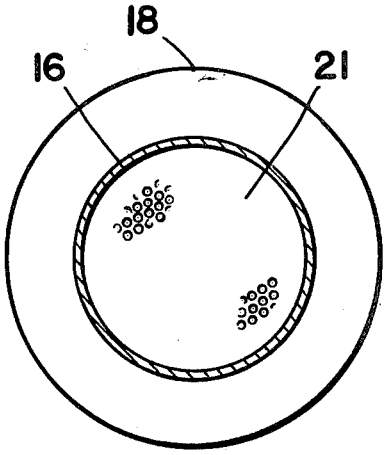
FIG. 5 is a horizontal cross-sectional view of the heat exchanger shown in FIG. 2.

The present invention generally comprises such a high efficiency heat exchanger which may be used as the elements 13 or 15 in the Stirling cycle engine. As shown in FIG. 2, the heat exchanger of the present invention includes a generally cylindrical housing 16 which is disposed within an annular heating or cooling jacket 17. A plurality of radially extending fins 18 are secured to the exterior of the housing 16, and extend into the cavity 19 defined by the heating or cooling jacket 17. A flow of heating or cooling liquid such as water or liquid metal is maintained in the cavity 19 to exchange heat from the fins 18 and thus with the housing and the interior of the heat exchanger.

Within the housing 16 is disposed a plurality of disc-like heat exchanger plates 21. The plates 21 are disposed in axially spaced relationship, and are supported at their peripheral edges by the housing 16. Joined to one end of the cylindrical housing 16 is a manifold 22 which serves as both an intake and exhaust manifold. The flared shape of the manifold 22 assures that the working fluid of the engine is delivered to the entire surface area of the plates 21. The flared portion of the manifold 22 may be provided with an exponential outward flare to enhance the non-turbulent flow of the working fluid to the plate 21.

Figure 3:
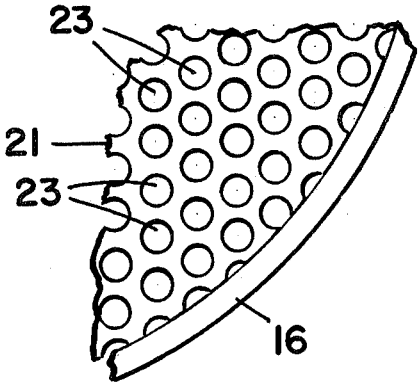
FIG. 3 is a detailed view of a peripheral portion of a heat exchanging plate of the present invention.

The housing 16 is completely sealed, except for the manifold 22 and the port at the other end, not shown, which connects with the regenerator 14. It may be appreciated that the heat exchanger of the present invention is intended for axial flow. As shown in FIG. 3, each of the plates 21 is provided with a plurality of holes 23 extending therethrough in a direction parallel to the axis of the housing 16. The holes 23 occupy something less than half of the surface area of each of the plates 21, and are disposed in a regular, non-orthogonal matrix. All of the plates 21 are identical, and the matrices of holes formed therein are also identical.

Figure 4:
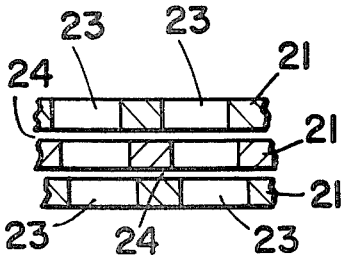
FIG. 4 is a detailed cross-sectional view showing the alignment of perforations in the heat exchanging plates of the present invention.

A most salient feature of the present invention, as shown in FIG. 4, is that the plates 21 are disposed with the holes 23 misaligned to a predetermined extent. The misalignment is on the order of approximately two percent; that is, a projection of the surface area of one hole 23 upon the corresponding hole on the adjacent plate would show that only 98° of the area of the two holes is coincident in a direction parallel to the axis of the housing 16. Thus, approximately two percent of the working fluid passing in an axial direction through each plate 21 is diverted from axial flow.

Figure 6:
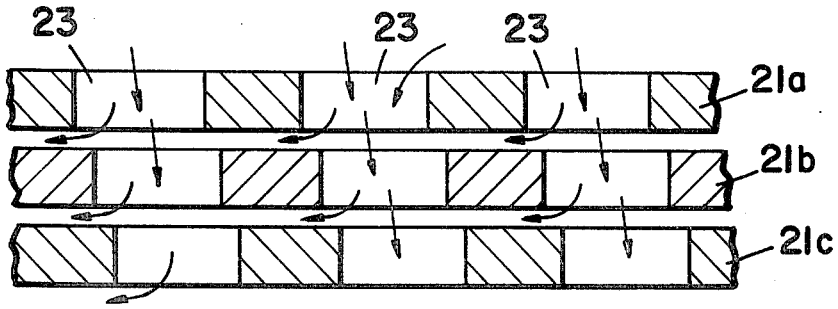
FIG. 6 is a detailed cross-sectional view of a plurality of heat exchanging plates of the present invention, showing the fluid flow through the perforations and laminar spaces.

As shown in FIG. 6, this purposeful and predetermined misalignment of the holes 23 produces a significant result in the flow of the working fluid through the heat exchanger. As the fluid passes through the holes in plate 21A, the succeeding holes through which that portion of the fluid could flow has the appearance depicted in FIG. 7. Approximately two percent of the fluid flow through the hole in plate 21A is sheared off by the edge 23B extending into the flow stream, and diverted into laminar flow between the plates 21A and 21B. This process is repeated as the fluid stream traverses more consecutive plates 21. The portions of the fluid streams that are diverted into laminar flow in the gaps 24 between the plates 23 are exposed to a large amount of surface area of the plates. This large surface exposure occasions a high rate of heat transfer to the plates 21, and is in part responsible for the high efficiency of the heat exchanger of the present invention. Heat is conducted through the plates 21 to the housing 16, or vice versa.

The axial spacing of the plates 23 to form the gaps 24 is also a significant feature of the present invention. Generally speaking, the volume of each gap 24 between adjacent plates 23 is equal to the volume of working fluid which is sheared off by the misalignment of the holes 23. That is, the volume of the gap 24 is approximately equal to two percent of the sum of the cross-sectional volumes of the holes 23 in one of the plates 21. This particular spacing assures a laminar flow between the plates, and also an impedance match in the fluid flow paths.

Figure 7:
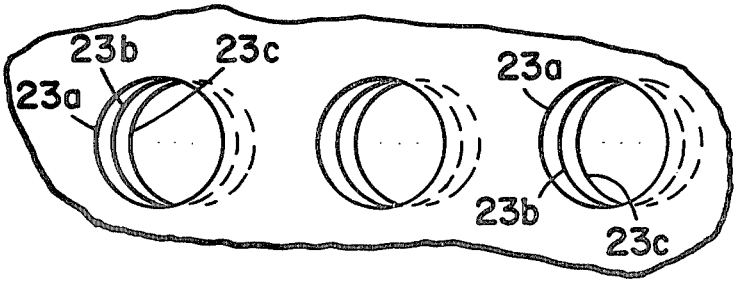
FIG. 7 is an end view showing the alignment of the perforations of successive heat exchanging plates of the present invention.

It may be appreciated that the staggered spacing of the holes 23, which is shown in FIGS. 4, 6, and 7, is occasioned by the plate 21 being angularly offset about a pivot axis which is coaxial with the major axis of the housing 16. Another significant effect of this offset is that a major portion of a fluid stream passing through a hole 23 is diverted slightly laterally in a direction which is always normal to the axis of the device. The cumulative effect of this misalignment and diversion is to impart a helical flow pattern to the working fluid as it passes through the heat exchanger.

The helical path described by the working fluid imparts an angular momentum thereto, and causes the fluid to move radially outwardly by virtue of the centrifugal force exerted thereon. Thus the axial flow through the housing 16 is diverted to a helical flow which, by virtue of the centrifugal force acting thereon, expands in the radial direction to flow through the entire volume of the heat exchanger. Thus the volume of the heat exchanger in which active heat transfer is taking place is maximized.

To further match the fluid flow impedances, the diameter of the throat 26 of the manifold 22 is selected so that the cross-sectional area of the throat 26 is equal to the effective cross-sectional flow area of each plate; that is, the number of holes in each plate times the area per hole. This impedance matching enhances the adiabatic thermal exchange which is necessary for Stirling cycle operation. When the direction of fluid flow is reversed, as is the case in a Stirling cycle engine, the heat exchanger performs exactly as described in the foregoing.

Figure 8:
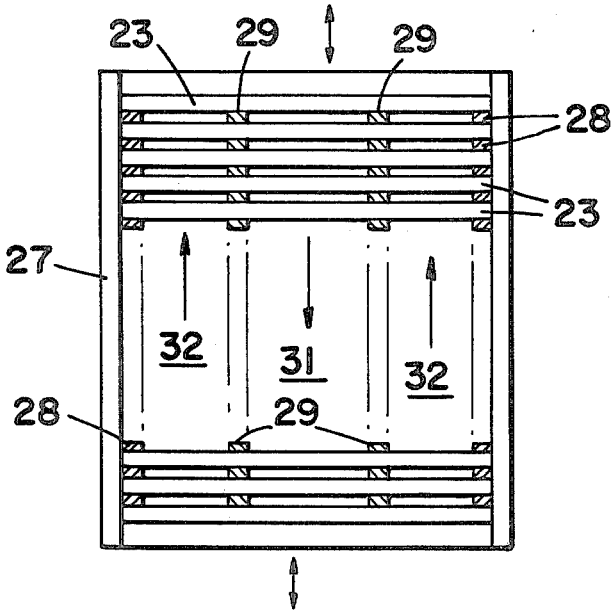
FIG. 8 is an axial cross-sectional view of an alternative embodiment of the present invention.
Figure 9:
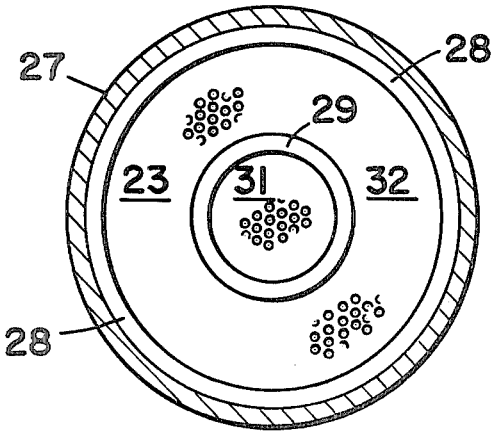
FIG. 9 is a horizontal cross-sectional view of the alternative embodiment shown in FIG. 8.

An alternative embodiment of the present invention, shown in FIGS. 8 and 9, is commonly known as a counterflow heat exchanger. It includes a generally cylindrical housing 27 which supports therein a plurality of heat exchanging plates 23, as described in the foregoing. The plates are spaced apart by a plurality of annular outer gaskets 28, one disposed between each pair of adjacent plates. The gaskets 28 act as spacers as well as sealing means.

The alternative embodiment also includes a plurality of annular inner gaskets 29 which are equal in thickness to the gaskets 28, yet are much smaller in diameter. The gaskets 29 are arranged concentrically about the axis of the housing 27, and they also serve as spacers as well as sealing means to define an axial flow space 31 and an outer annular flow space 32. The spacers 29 seal off the two flow spaces 31 and 32, so that distinct working fluids may occupy each space without intermixing.

It may be appreciated, however, that each of the plates 23 extends through both of the flow spaces 31 and 32. Thus separate working fluids may flow in a generally axial direction through the spaces 31 and 32, and a heat transfer process will take place through the heat exchanging plates 23. The flow paths in each of the spaces 31 and 32 will be substantially as described in the foregoing, the difference being that in the alternative embodiment, counterflows of working fluids at different temperatures may take place in the separate flow spaces.

I claim:

1. A heat exchanger, comprising a housing adapted for generally axial flow of a working fluid therethrough, a plurality of heat exchanger plates supported in said housing in spaced, parallel relationship, a plurality of holes disposed in each of said plates, generally parallel to the axis of said housing and arrayed in matrix format, each of said plates being angularly offset a predetermined amount about said axis from the adjacent plates, said matrix format of said holes being identical in all of said plurality of plates, and said predetermined amount of angular offset is equivalent to an approximately 2% misalignment of said holes in adjacent plates.

2. A heat exchanger, comprising a housing adapted for generally axial flow of a working fluid therethrough, a plurality of heat exchanger plates supported in said housing in spaced, parallel relationship, a plurality of holes disposed in each of said plates, generally parallel to the axis of said housing and arrayed in matrix format, each of said plates being angularly offset a predetermined amount about said axis from the adjacent plates, each pair of adjacent plates defines an annular gap having a predetermined volume, said predetermined volume being equal to the volume of the portions of said holes which are misaligned with said holes of an adjacent plate.

3. A heat exchanger, comprising a housing adapted for generally axial flow of a working fluid therethrough, a plurality of substantially identical heat exchanger plates supported in said housing in spaced, parallel relationship, a plurality of holes disposed in each of said plates, generally parallel to the axis of said housing and arrayed in matrix format, each of said plates being angularly offset a predetermined amount about said axis from the adjacent plates so that each hole includes a substantial portion axially aligned with and the remaining portion axially misaligned with a hole of the adjacent plate, and each pair of adjacent plates defining an annular gap having a fixed through flow volume to pass therethrough the air laterally diverted due to the axial misalignment of the holes; and at least one delivery manifold joined to one end of said housing, said manifold including a throat and a flared portion extending therefrom to said housing, said throat having a cross-sectional area substantially equal to the cross-sectional area of said plurality of holes in one of said plates.

4. A Stirling cycle engine including a plurality of cylinders and a piston slidably disposed in each cylinder, and a fluid connection extending from the upper portion of each cylinder through at least one heat exchanger to the bottom portion of another cylinder, wherein the improvement comprises said heat exchanger including a housing adapted for generally axial flow of a working fluid therethrough, a plurality of substantially identical heat exchanger plates supported in said housing in spaced, parallel relationship, a matrix of holes disposed in each of said plates, generally parallel to the axis of said housing, each of said plates being angularly offset a preselected amount about said axis from the adjacent plates, so that each hole includes a substantial portion axially aligned with and the remaining portion axially misaligned with a hole of the adjacent plate, and each pair of adjacent plates defining an annular gap having a fixed through flow volume to pass therethrough the air laterally diverted due to the axial misalignment of the holes, said fluid connection including a fluid conducting tube, and a flared member connecting said fluid conducting tube and said housing, said fluid conducting tube having a cross-sectional area equal to the total cross-sectional area of said plurality of holes in one of said plates.

5. The improved Stirling cycle engine of claim 4, wherein said flared member is provided with an exponential, outwardly flared curve from said tube to said housing.

* * * * *